US007401381B2

(12) United States Patent
Konja et al.

(10) Patent No.: US 7,401,381 B2
(45) Date of Patent: Jul. 22, 2008

(54) FOLDING MECHANISM

(75) Inventors: Takehiko Konja, Fukui (JP); Katsuichi Minami, Fukui (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 293 days.

(21) Appl. No.: 11/254,411

(22) Filed: Oct. 20, 2005

(65) Prior Publication Data

US 2006/0112515 A1 Jun. 1, 2006

(30) Foreign Application Priority Data

Dec. 1, 2004 (JP) ..... 2004-348087

(51) Int. Cl.
*E05F 1/14* (2006.01)

(52) U.S. Cl. ..... 16/285; 16/330; 16/303

(58) Field of Classification Search ..... 16/285, 16/284, 303, 330; 348/373, 794, 333.06; 379/433.12, 433.13; 361/680–683; 455/575.1, 455/575.3, 575.4, 550.1, 90.3
See application file for complete search history.

(56) References Cited

U.S. PATENT DOCUMENTS 5,109,571 A * 5/1992 Ohshima et al. ..... 16/307
5,566,048 A * 10/1996 Esterberg et al. ..... 361/681
5,923,751 A * 7/1999 Ohtsuka et al. ..... 379/433.13
6,389,611 B2 * 5/2002 Fujita ..... 4/236
6,601,269 B2 * 8/2003 Oshima et al. ..... 16/342
6,634,061 B1 * 10/2003 Maynard ..... 16/342
6,789,292 B2 * 9/2004 Oshima et al. ..... 16/297
6,829,807 B2 * 12/2004 Kim ..... 16/322
7,065,834 B2 * 6/2006 Lowry ..... 16/330
2003/0172494 A1 * 9/2003 Oshima et al. ..... 16/285
2004/0074049 A1 * 4/2004 Kawamoto ..... 16/256

FOREIGN PATENT DOCUMENTS

JP 07158665 A * 6/1995
JP 2002-335316 A 11/2002

* cited by examiner

*Primary Examiner*—Chuck Y. Mah
(74) *Attorney, Agent, or Firm*—RatnerPrestia

(57) ABSTRACT

A folding mechanism is provided in which a rotor substantially tubelike is arranged between the stationary body and movable body; cams with given gaps are arranged at both ends of the rotor and on the facing surfaces of the stationary body and movable body; and a lubricating layer is formed between the outer circumference of the stationary shaft and the inner circumference of the rotor. The simple makeup implements a folding mechanism with a low impact when opening and reliable opening/closing operation.

3 Claims, 4 Drawing Sheets

FOLDING MECHANISM

FIELD OF THE INVENTION

The present invention relates to a folding mechanism used for various types of electronic devices such as a mobile phone and personal computer.

BACKGROUND OF THE INVENTION

With downsizing and weight reduction of electronic devices such as a mobile phone and personal computer proceeding in recent years, devices with its movable housing openably and closably attached to its stationary housing, so-called a folding type, have been increasing. Accordingly, in folding mechanism used for these devices, reliable opening/closing operation and ease of use are demanded.

A description will be made for such a conventional folding mechanism, using FIGS. 4 and 5. FIG. 5 is an exploded perspective view of the conventional folding mechanism. As shown in the figure, stationary part 1A is formed on the left side of stationary body 1 substantially tubelike. Stationary body 1 is fastened onto the left end of stationary shaft 2 substantially column-shaped, and at the same time, stationary shaft 2 projects to the right from the center of the right side of stationary body 1.

Further, stationary body 1 is integrally fastened to stationary case 3 with stationary part 1A projected from the left side of stationary case 3 substantially tubelike, and also notch 3A is provided at the left end of stationary case 3.

Meanwhile, movable body 4 substantially ring-shaped is polygonal. Movable case 5 is substantially tubelike. Movable body 4 is integrally fastened onto the right inner surface of movable case 5, and also they are arranged rotatably in the open/close direction as against stationary body 1.

Additionally, coiled spring 6 is arranged in a slightly twisted state between the right side of stationary body 1 and the left side of movable body 4. Projection 6A at the left end and projection 6B at the right end are locked to notch 3A of stationary case 3 and notch 4A of movable body 4, respectively. In this way, movable body 4 is biased in the open direction as against stationary body 1, namely counterclockwise, by means of spring 6.

The right end of stationary shaft 2 is inserted into the hollow of movable body 4 and spring 6, and is rotatably attached on the right side of movable case 5 by means of retaining ring 7. Stationary part 1A of stationary body 1 rotatably projects from the left side of movable case 5. Stationary body 1, movable body 4, spring 6, and others are contained in movable case 5 to compose folding mechanism 10.

Folding mechanism 10 composed in this way is used for an electronic device such as a mobile phone shown in FIG. 4B. Stationary part 1A of stationary body 1 is fastened to stationary housing 22 formed on its top surface with operation unit 22A having a plurality of keys and audio input unit 22B such as a microphone. Further, the outer circumference of polygonal part 5A at the right end of movable case 5 is fastened to movable housing 23 formed on its surface with display unit 23A such as an LCD and audio output unit 23B such as a speaker. In this way, a mobile phone is composed with movable housing 23 pivotally supported openably and closably as against stationary housing 22 by means of folding mechanism 10.

In the above-mentioned makeup, in a state of movable housing 23 as shown in FIG. 4A closed, movable body 4 is biased in the open direction as against stationary body 1, namely counterclockwise, because spring 6 of folding mechanism 10 is in the most twisted state. Meanwhile, movable housing 23 is locked to stationary housing 22 by means of a key-like ratchet (not illustrated) provided between stationary housing 22 and movable housing 23, and thus movable housing 23 is retained in a closed state. When push button 24 on the side of stationary housing 22 is pressed in this closed state, the ratchet is released to bias movable body 4 in the open direction, namely counterclockwise, by means of spring 6. Accordingly, a force to open is applied to movable housing 23 as shown by the arrow in FIG. 4B.

After then, as shown in FIG. 4C, when movable housing 23 opens at a given angle of around 150 to 170 degrees as against stationary housing 22, a force in the open direction of folding mechanism 10 is stopped by means of a stopper mechanism (not illustrated) separately provided between stationary housing 22 and movable housing 23. Consequently, a state of movable housing 23 open at a given angle is retained.

That is to say, as a result that push button 24 is pressed, movable body 4 fastened to movable housing 23 through movable case 5 and biased by spring 6 in the open direction is rotated to open and close movable housing 23 as against stationary housing 22.

An electronic device having such a makeup is disclosed in Japanese Patent Unexamined Publication No. 2002-335316.

However, in the conventional folding mechanism mentioned above, when pressing push button 24 to open movable housing 23 at a given angle, and stopping a force in the open direction of folding mechanism 10 by means of the stopper mechanism between stationary housing 22 and movable housing 23, a turning force of movable body 4 biased by spring 6 transmits to stationary housing 22 and movable housing 23 as an impact. Consequently, a loose grasp of the electronic device may cause the device to fall off the hand due to this impact. In order to prevent this problem, a damper mechanism made of an elastic body such as rubber needs to be provided separately between stationary housing 22 and movable housing 23, resulting in a complicated structure of the device.

SUMMERY OF THE INVENTION

The present invention provides a folding mechanism in which a substantially tubelike rotor is arranged between a stationary body with a stationary shaft projecting on the center of its side, and a movable body rotatably arranged as against this stationary body; cams with given gaps are arranged at both ends of the rotor and on the facing surfaces of the stationary body and movable body; and a lubricating layer is formed between the outer circumference of the stationary shaft and the inner circumference of the rotor. In this way, after the movable body rotates to some extent to touch the cam of the rotor, and before the movable housing completely opens, the movable body rotates slowly due to the influence of the viscosity of the lubricating layer through the rotor touched by the cam. Consequently, a folding mechanism can be provided that gives a low impact and allows reliable opening/closing operation with a simple makeup.

The present invention further provides a folding mechanism formed with a lubricating layer between the outer circumference of the stationary body and the inner circumference of the movable case containing the stationary body, movable body, spring, and rotor. In this way, a folding mechanism is available that gently rotates the movable body from immediately after opening.

DETAILED DESCRIPTION OF PREFERRED EMBODIMENT

Figure 1:
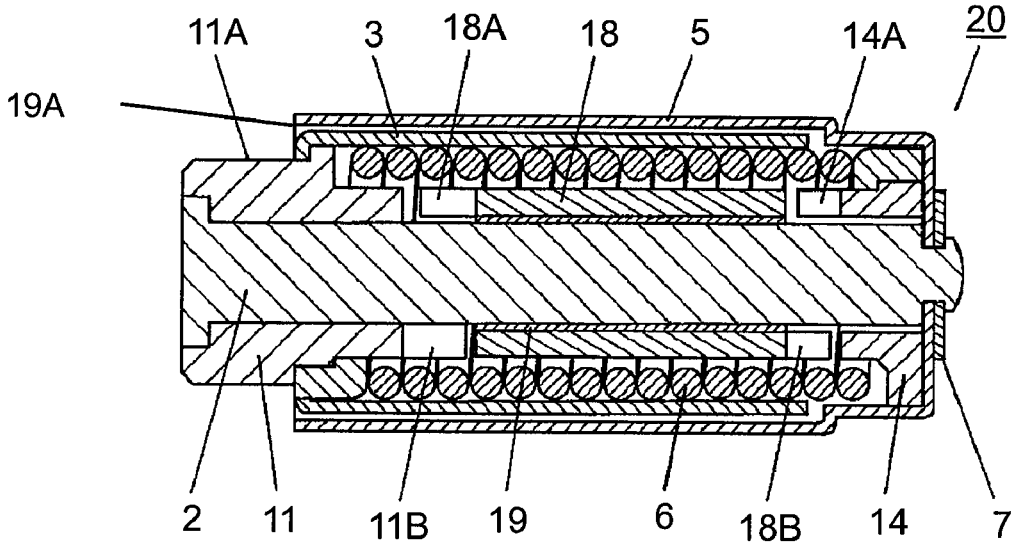
FIG. 1 is a sectional view of a folding mechanism according to an embodiment of the present invention.

Hereinafter, a description will be made for an embodiment of the present invention, using FIGS. 1 through 4C. The drawings are schematic and do not show respective dimensional positions correctly. Here, FIG. 1 shows each component radially enlarged in order for the relationship between the stationary cam and movable cam to be easily understood. For a part with a makeup same as that under Background Art, the same mark is given to simplify its detailed description.

Embodiment

Figure 2:
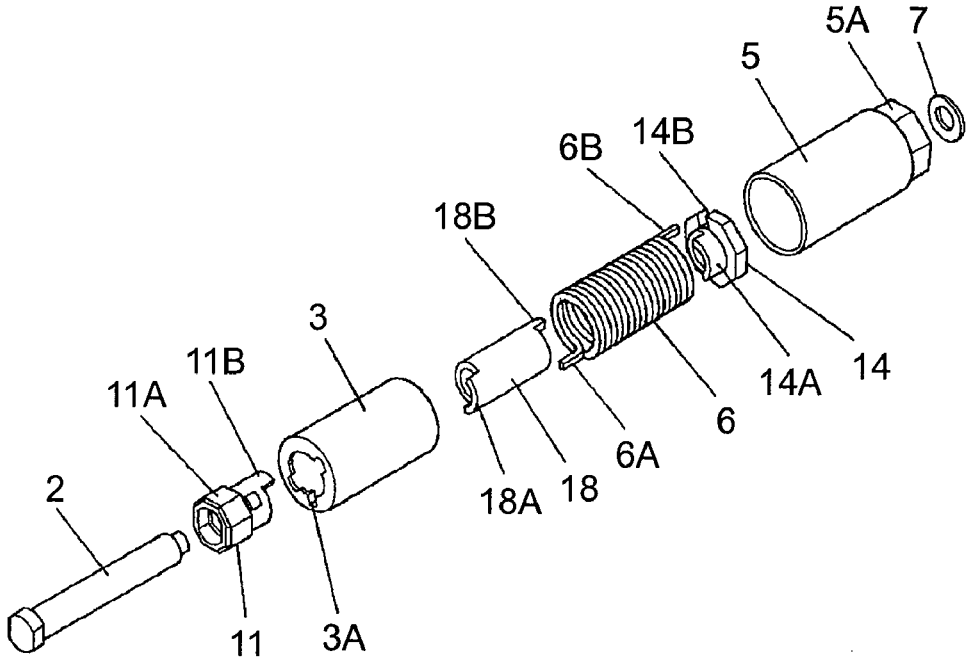
FIG. 2 is an exploded perspective view of the folding mechanism shown in FIG. 1.

As shown in FIGS. 1 and 2, stationary part 11A is formed on the left side of stationary body 11 substantially tubelike. Stationary body 11 is made of synthetic resin, steel, copper alloy, sintered alloy, or the like.

Stationary body 11 is fastened at the left end of stationary shaft 2 substantially column-shaped, and stationary shaft 2 projects to the right from the center of the right side of stationary body 11. Besides, cam 11B projecting to the right is provided on the outer circumference of the right side of stationary body 11.

Then, stationary part 11A is projected from the left side of stationary case 3 substantially tubelike, made of metal or synthetic resin, and stationary body 11 is integrally fastened to stationary case 3. Still, notch 3A is provided at the left end of stationary case 3.

Movable body 14 substantially ring-shaped, made of synthetic resin or metal, is polygonal. Movable case 5 is substantially tubelike. Movable body 14 is integrally fastened on the right inner surface of movable case 5, and these are arranged rotatably in the open/close direction as against stationary body 11.

The outer circumference of the left side of movable body 14 is provided thereon with cam 14A projecting to the left.

Further, coiled spring 6 is arranged in a slightly twisted state between the right side of stationary body 11 and the left side of movable body 14. Then projection 6A at the left end and projection 6B at the right end are locked to notch 3A of stationary case 3 and notch 14B of movable body 14, respectively. Movable body 14 is biased in the open direction, namely counterclockwise, as against stationary body 11 by spring 6.

Then rotor 18 substantially tubelike, arranged between stationary body 11 and movable body 14, is contained in stationary case 3 along with spring 6.

The facing surfaces of stationary body 11 and movable body 14 at both ends of rotor 18 are provided thereon with cams 18A and 18B projecting to the left and right, respectively.

Figure 3A:
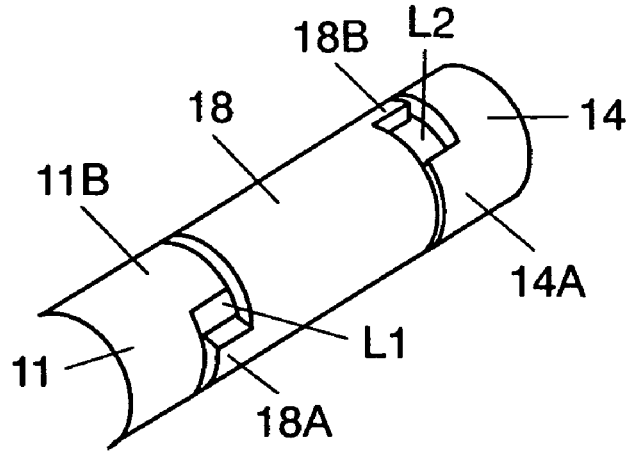
FIGS. 3A through 3C are partial perspective views of the folding mechanism shown in FIG. 1.

Here, as shown in FIG. 3A, given gaps L1 and L2 are provided between cam 18A at the left end of rotor 18 and cam 11B at the right side of stationary body 11; and between cam 18B at the right end and cam 14A at the left side of movable body 14, respectively.

As shown in FIG. 1, lubricating layer 19 is formed with silicone-based lubricating grease with high viscosity applied, between the inner circumference of rotor 18 and the outer circumference of stationary shaft 2 inserted into the rotor.

Further, the right end of stationary shaft 2 is inserted into the hollow of movable body 14 and is rotatably attached to the right side of movable case 5 by means of retaining ring 7. Stationary part 11A of stationary body 11 rotatably projects from the left side of movable case 5. Stationary body 11, movable body 14, spring 6, and others are contained in movable case 5 to compose folding mechanism 20.

Figure 4A:
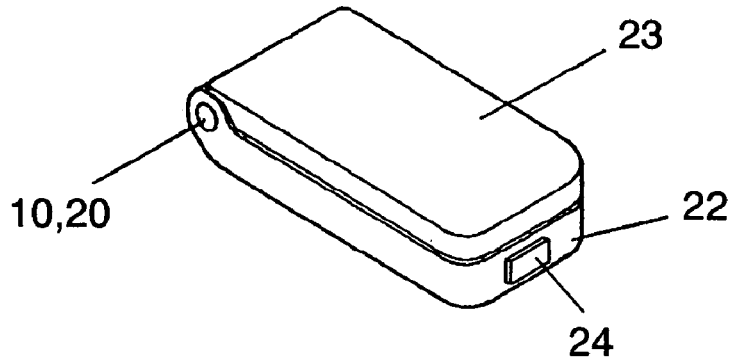
FIGS. 4A through 4C are perspective views for illustrating the makeup of a mobile phone.
Figure 4B:
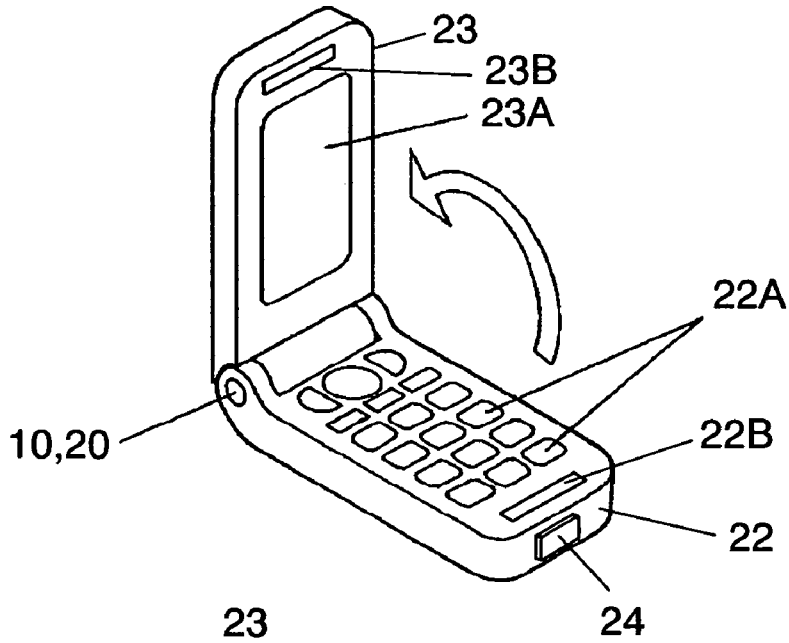

Then folding mechanism 20 composed in this way is used for an electronic device such as a mobile phone shown in FIG. 4B. Stationary part 11A of stationary body 11 is fastened to stationary housing 22 formed on its top surface with operation unit 22A having a plurality of keys and audio input unit 22B such as a microphone. Further, the outer circumference of polygonal part 5A at the right end of movable case 5 is fastened to movable housing 23 formed on its surface with display unit 23A such as an LCD and audio output unit 23B such as a speaker. In this way, an electronic device is composed with movable housing 23 pivotably supported openably and closably as against stationary housing 22 by means of folding mechanism 20.

In the above-mentioned makeup, in a state of movable housing 23 shown in FIG. 4A closed, which is a state of spring 6 of folding mechanism 20 most twisted, movable body 14 is biased in the open direction as against stationary body 11, namely counterclockwise. Meanwhile, movable housing 23 is locked to stationary housing 22 by means of a key-like ratchet (not illustrated) provided between stationary housing 22 and movable housing 23, and thus movable housing 23 is retained in a closed state. When push button 24 on the side of stationary housing 22 is pressed in this closed state, the ratchet is released to bias movable body 14 in the open direction, namely counterclockwise, by means of spring 6. Consequently, as shown by the arrow in FIG. 4B, a force in the open direction is applied to movable housing 23 with movable body 14 fastened to it, and movable housing 23 promptly opens at around 90 degrees.

Figure 3B:
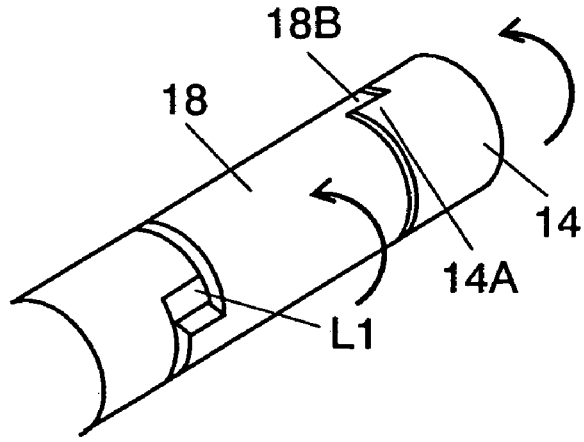

At this moment, as shown by the arrow in FIG. 3B, with the rotation of movable body 14 in the open direction, cam 14A on the left side rotates as well to reduce gap L2, and consequently cam 14A touches cam 18B at the right end of rotor 18.

Figure 4C:
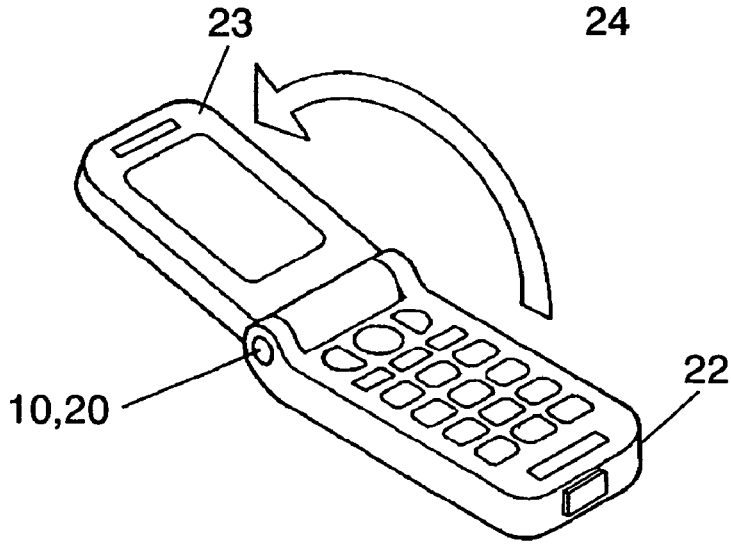
Figure 5:
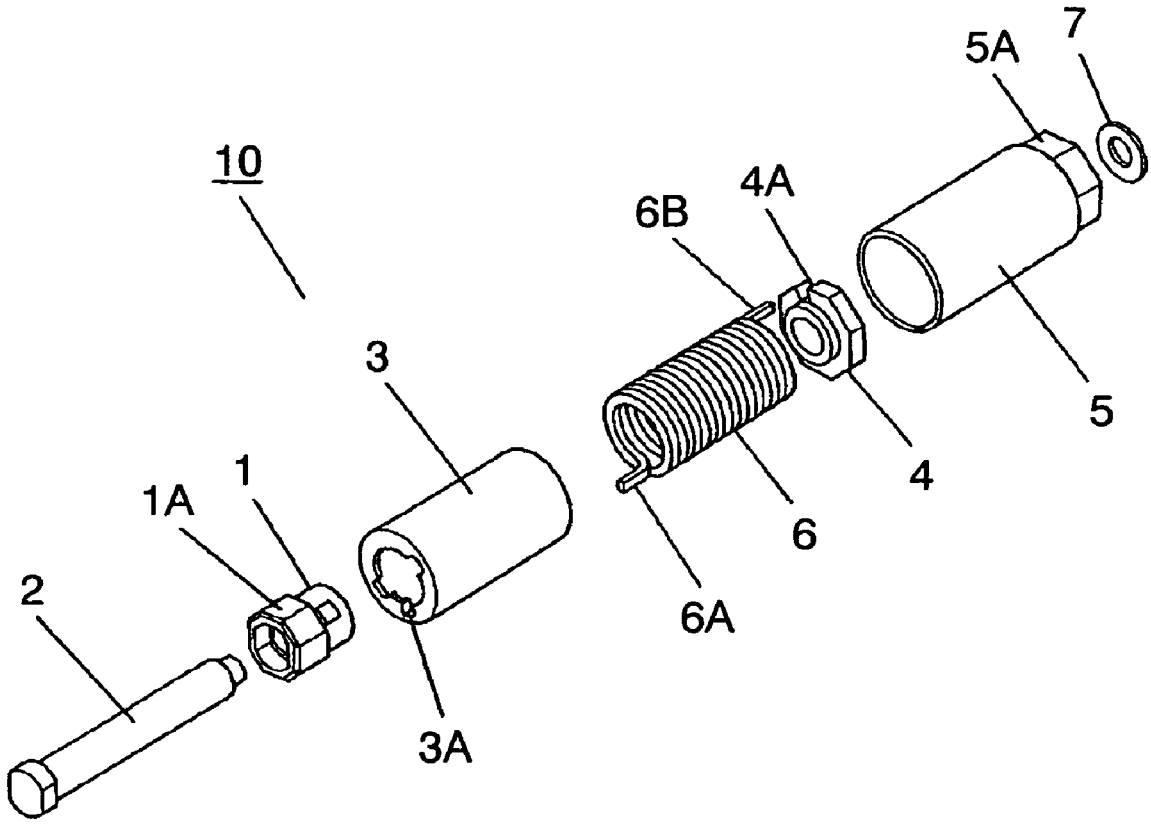
FIG. 5 PRIOR ART
FIG. 5 is an exploded perspective view of the conventional folding mechanism.

After then, from the state of FIG. 4B until movable housing 23 opens at a given angle of around 150 to 170 degrees as against stationary housing 22, as shown in FIG. 4C, rotor 18 with cam 18B pressed by cam 14A rotates in the open direction along with movable body 14 biased by spring 6.

At this moment, lubricating layer 19 with high viscosity is formed between the inner circumference of rotor 18 and the outer circumference of stationary shaft 2 inserted into rotor 18, and thus movable housing 23 opens gently from the state of FIG. 4B until opening at the angle shown in FIG. 4C.

Figure 3C:
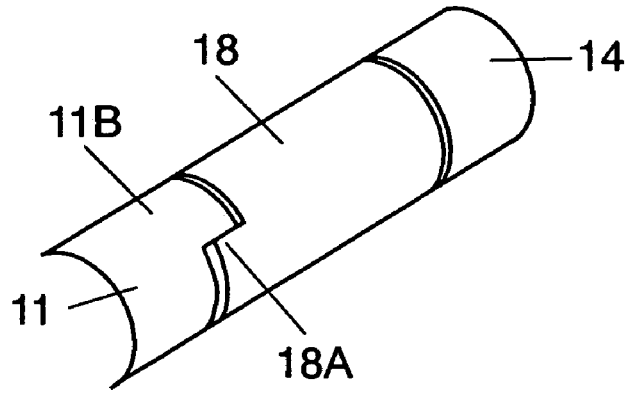

Then as shown in FIG. 3C, gap L1 is reduced as well, and cam 18A at the left end of rotor 18 touches cam 11B at the right side of stationary body 11, causing movable body 14 to stop rotating in the open direction. In this way, as shown in FIG. 4C, a state of movable housing 23 open at a given angle is retained.

That is to say, by pressing push button 24, movable body 14 fastened to movable housing 23 through movable case 5, and biased in the open direction by spring 6, is rotated to open and close movable housing 23 as against stationary housing 22.

Movable housing 23 promptly opens from the state of FIG. 4A until opening at the angle shown in FIG. 4B, that is to say, until cam 14A touches cam 18B. Further, movable housing 23 gently opens from the state of FIG. 4B until opening at the angle shown in FIG. 4C, owing to the viscosity of lubricating layer 19 between the inner circumference of rotor 18 and the outer circumference of stationary shaft 2.

Therefore, when movable housing 23 opens in the state of FIG. 4C, a turning force of movable body 14 biased by spring 6 does not transmit to stationary housing 22 or movable housing 23 as an impact, thus preventing the electronic device from falling. Consequently, stationary housing 22 and movable housing 23 do not need a damper mechanism made of an elastic body such as rubber to be separately provided. Additionally, as a result that cam 18A of rotor 18 touches cam 11B of stationary body 11, movable housing 23 can be reliably retained at a given angle with a simple makeup.

Here, lubricating layer 19 is preferably formed between the outer circumference of stationary case 3 integrated with stationary body 11 and the inner circumference of movable case 5, as well as between the inner circumference of rotor 18 and the outer circumference of stationary shaft 2. This makeup allows movable housing 23 to open in a relatively gentle manner until opening at the angle shown in FIG. 4B as well, and then to open further gently until opening at the angle shown in FIG. 4C.

Changing the shapes of cams 18A and 18B at both ends of rotor 18, cam 11B of stationary body 11, and cam 14A of movable body 14, allows given gaps L1 and L2 between each cam, as well. In this way, an angle range in which movable housing 23 opens in a relatively prompt manner, and that in a gentle manner can be arbitrarily set.

As described above, this embodiment provides a folding mechanism in which rotor 18 substantially tubelike is arranged between stationary body 11 and movable body 14; cams with given gaps L1 and L2 are arranged at both ends of rotor 18 and on the facing surfaces of stationary body 11 and movable body 14; and lubricating layer 19 is formed between the outer circumference of stationary shaft 2 and the inner circumference of rotor 18. In this way, after movable body 14 rotates to some extent to touch cams 14A and 18B of movable body 14 and rotor 18, until movable housing 23 completely opens, movable body 14 rotates gently owing to the influence of the viscosity of lubricating layer 19. Consequently, a folding mechanism can be provided that gives a low impact when opening and that allows reliable opening/closing operation with a simple makeup.

Further, forming lubricating layer 19 between the outer circumference of stationary case 3 integrated with stationary body 11 and the inner circumference of movable case 5 as well, allows movable housing 23 to open in a relatively gentle manner in some angle range, and then to open in a further gentle manner in an angle range until completely opening.

Here in this embodiment, the description is made for the makeup in which movable body 14 and movable case 5, or stationary body 11, stationary shaft 2, and stationary case 3, all separate parts, are fastened to form parts at the movable side and those at the stationary side. However, the present invention can be implemented even if these two or three parts are respectively integrated, although the manufacturing process becomes difficult.

Meanwhile, the description is made for the makeup that uses a twisting force of coiled spring 6 arranged between movable body 14 and stationary body 11, as a means to bias movable body 14 in the open direction as against stationary body 11. Besides, various makeups can be used for biasing movable body 14 in the open direction, such as making the projection of movable body 14 elastically contact the gradient part of stationary body 11 by means of a compression coil spring or the like.

Meanwhile, lubricating layer 19 formed between the outer circumference of stationary shaft 2 and the inner circumference of rotor 18, and lubricating layer 19A formed between the outer circumference of stationary case 3 and the inner circumference of movable case 5, may use the following lubricating greases. That is, lubricating grease made of a lubricant based on fluorine, ester, glycol, or the like may be applied. From the aspect of high performance, stability at low temperatures, and others, lubricating grease made of a lubricant based on silicone, olefin, or the like is preferably used.

The present invention provides a folding mechanism that allows reliable opening/closing operation with a simple makeup, to be widely used for various types of electronic devices.

What is claimed is:

1. A folding mechanism for folding a first housing with respect to a second housing, the folding mechanism comprising:

a stationary body with a stationary shaft projecting at a center of a side of the stationary body, the stationary body coupled to one of the first housing or the second housing;

a movable body arranged rotatably as against the stationary body;

a spring for biasing the movable body in an open direction as against the stationary body;

a rotor substantially tube-like, arranged between the stationary body and the movable body; and a movable case substantially tube-like, that contains the stationary body, the movable body, the spring, and the rotor, the movable case coupled to the other of the first housing or the second housing, wherein the rotor includes first and second rotor cams at opposite ends of the rotor, the stationary body includes a stationary cam, the movable body includes a movable cam and gaps are arranged (a) between the first rotor cam and the stationary cam and (b) between the second rotor cam and the movable cam;

wherein the stationary shaft is rotatably coupled to the movable case; and wherein a first lubricating layer is formed between an outer circumference of the stationary shaft and an inner circumference of the rotor.

2. The folding mechanism as claimed in claim 1, wherein the folding mechanism further comprises:

a stationary case coupled to the stationary body: and a second lubricating layer formed between an outer circumference of the stationary case and an inner circumference of the movable case.

3. The folding mechanism as claimed in claim 2, wherein the lubricating layer is made of a lubricating grease.

* * * * *